United States Patent [19]

Nuttall et al.

[11] 4,445,718

[45] May 1, 1984

[54] SECURITY DOORS

[75] Inventors: Brian Nuttall, Sheriffhales; Charles F. Laxson, Tettenhall, both of England

[73] Assignee: Chubb & Son's Lock and Safe Company, London, England

[21] Appl. No.: 362,820

[22] Filed: Mar. 29, 1982

[30] Foreign Application Priority Data

Apr. 22, 1981 [GB] United Kingdom ..... 8112476

[51] Int. Cl.[3] ..... E05C 13/00

[52] U.S. Cl. ..... 292/341.17

[58] Field of Search ..... 292/341.17, 341.16, 292/1, 144, 335; 49/141, 400

[56] References Cited

U.S. PATENT DOCUMENTS

| | | | |
|---|---|---|---|
| 2,723,873 | 11/1955 | Schloge | 292/335 |
| 2,736,401 | 2/1956 | Milone | 49/400 X |
| 3,105,992 | 10/1963 | Carlson | 49/141 X |
| 3,360,970 | 1/1968 | Hays, Jr. | 292/144 X |
| 4,098,025 | 7/1978 | Stock et al. | 49/400 X |
| 4,110,867 | 9/1978 | Gwoydy | 49/141 X |

*Primary Examiner*—Richard E. Moore

*Attorney, Agent, or Firm*—Pollock, Vande Sande and Priddy

[57] ABSTRACT

A security door, adapted to close off a secure area, is supported in hinges which allow the door either to open inwards to, or outwards from, that area. Normally the door is arranged for inward opening, and closes against a strike assembly including a stop member and a bar, both screwed to the door frame. If the normal inward opening path of the door should become blocked, access can still be gained to the secure area from the outside by releasing the components of the strike assembly from the frame and then opening the door outwards. However, even with the strike parts removed the lock bolt still engages in an aperture in the door frame so access can be gained to the area in this way only by key-holders or equivalent authorized personnel.

4 Claims, 2 Drawing Figures

SECURITY DOORS

The present invention relates to security doors.

More particularly, the invention is concerned with an arrangement in which there is a door for closing off a secure area which normally can be unlocked only from outside that area and which normally opens inwards in relation to that area. In this respect the invention seeks to provide a means whereby, in the event of some emergency in which the normal inward opening path of the door becomes blocked, authorised personnel can nevertheless gain access through the door into the secure area.

Accordingly the invention provides a door arrangement comprising: a security door which is hinged in relation to an associated frame in such a manner as to enable the door to open either inwards to, or outwards from, an area which the door is adapted to close; abutment means associated with the door frame to prevent the outward opening of the door, said abutment means being secured by releasable fastening means which are accessible only from outside said area; and a lock for selectively locking the door to the frame, which normally is operable to unlock the door only from outside said area and which can retain the door in engagement with the frame to resist opening of the door in either direction in the absence of said abutment means.

In an arrangement according to the invention the aforesaid abutment means can act to check the closing movement of the door and to absorb the impact and like forces from the door occasioned by normal usage. In an emergency where access must be gained to the area closed by the door in circumstances in which the inward opening path of the door becomes blocked, however, the fastening means which secure the abutment means can be released (from the outside) to enable removal of the latter and the door can then be opened outwards upon releasing the lock (also from the outside). It is a feature of the invention, however, that the lock can resist the opening of the door even in the absence of the abutment means, thereby to ensure that such emergency opening of the door remains under the control of authorised keyholders, (or equivalent operating personnel in the case of locks which are operated other than by keys).

Figure 1:
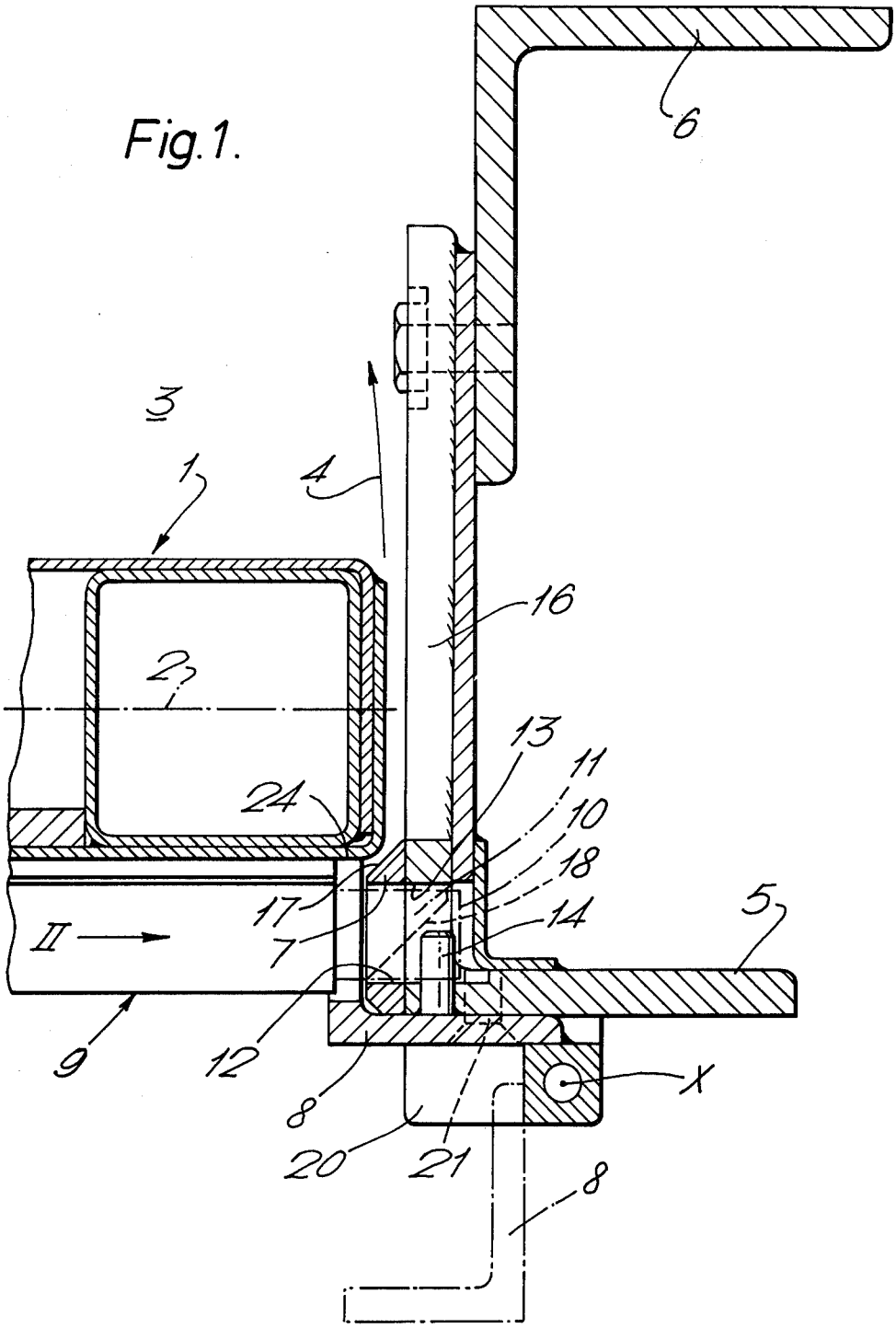
Figure 2:
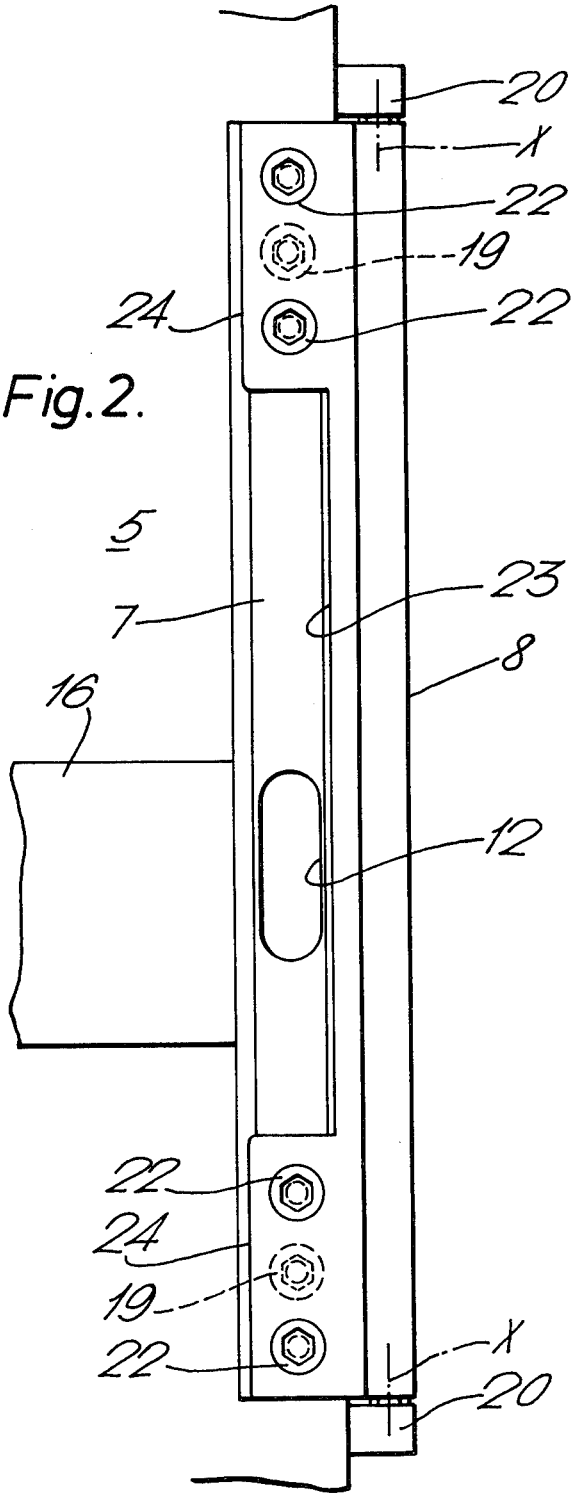

The invention will now be more particularly described, by way of example, with reference to the accompanying drawings, in which:

FIG. 1 is a horizontal section through part of a door and the associated frame embodying means in accordance with the invention; and FIG. 2 is a view, taken in the direction of the arrow II, of the strike assembly of the frame of FIG. 1, with the door opened.

Referring to FIG. 1, there is indicated an edge portion of a security door 1 which is borne remotely by pivot hinges (not shown) on a vertical axis intersecting its centre-line 2 so as to be capable of opening either inwards to or outwards from a secure room 3 bounded by the door. Normally, however, the door is constrained by the strike assembly described below to open only inwards into the room 3, that is in the sense of the arrow 4. Adjacent to the illustrated edge portion of the door the associated door frame comprises two main angle sections 5 and 6 secured around the free edge of the masonry or other structure bounding the door opening, and secured to angle section 5 in a manner to be more particularly described below is the compound strike assembly comprising a locking bar 7 and stop member 8.

Mounted on the outside face of the door is a lock 9. This lock may be, for example, a key-releasable automatic deadlock of which the bolt is indicated at 10, and which can be unlocked only from outside the room 3. Alternatively the lock may have a spring bolt 11 which can be deadlocked and released electrically from a remote location outside the room 3. In either case, in the locked condition of the door the bolt 10 or 11 is received within a slot 12 in the bar 7 and a cooperating aperture 13 in the angle section 5. A rigid pin 14 is mounted to intrude into the aperture 13 to restrict lateral movement of the bolt 11 in that aperture when the electrically-controlled lock is fitted, but is not necessary for the keylock. For use with the electrically-controlled lock, the angle section 5 is relieved at 16 (see also FIG. 2) to acommodate the head of the extended spring bolt 11 in the closing movement of the door, and the locking bar 7 has a bevelled edge 17 to cooperate with the bevelled edge 18 of the bolt head and permit the door to be slammed shut. When used with the keylock, the edge 17 operates a small snib or auxiliary bolt (not shown) to shoot and deadlock the main bolt 10 on closing the door.

The locking bar 7 is secured to the side face of the angle section 5 by two socket-headed screws 19 (see FIG. 2). The stop member 8 is essentially an L-shaped member, as best shown in FIG. 1, and is mounted between spaced brackets 20 secured to the front face of the angle section 5 so as to be capable of pivoting about the vertical axis X. Normally, however, the member 8 is held rigidly in its illustrated operative position by means of five equi-spaced socket-headed screws 21 (of which one is indicated in FIG. 1) passing into the front face of the angle section 5 and four similar screws 22 (FIG. 2) passing through the locking bar 7 and into the side face of the angle section 5. The side limb of the member 8 has a cut-out indicated at 23 in order to clear the case of the lock 9, the free edges 24 of this limb providing the stop faces against which the door 1 abuts to define its closed position.

In its normal operative position, therefore, the stop member 8 prevents the door 1 from being opened outwards from the room 3. A situation may arise, however, in which the normal inward opening path of the door within the room 3 becomes blocked, and in such a circumstance the invention makes it possible to gain access to the room from the outside by opening the door outwards. To this end, the screws 21 and 22 are removed and the stop member 8 is swung clear of the door 1, into the position shown in chain line in FIG. 1, in which position the stop faces 24 can no longer limit the movement of the door. As will be appreciated from that Figure, however, it is also necessary to release the locking bar 7 from the door frame to enable the door edge to pass outwardly, and this is achieved by removing the screws 19 which are exposed when the stop member 8 is swung away. In this condition the bar 7 remains captive on the lock bolt 10 or 11 which passes through its slot 12, but can be removed as the door is swung open when the bolt is subsequently withdrawn. It will be appreciated that the various screws 19,21 and 22 are accessible only from outside the room 3 and furthermore that even when the constraint imposed upon the door by the members 7 and 8 has been removed, opening of the door is still prevented by the engagement of the lock bolt 10 or 11 in the aperture 13 of the angle section 5, so the releasable strike components do not provide a way for unauthorised personnel to by-pass the lock operation. Upon withdrawal of the lock bolt, however, it is now possible to swing the door outwards and gain access to the room 3.

It is a further feature of the arrangement described above that if the screws 19,21,22 should be removed by unauthorised personnel outside the room 3 neither the stop member 8 nor the locking bar 7 can be completely separated from the door frame and carried away—the stop member 8 is retained in association with the frame between the mounting brackets 20 and the bar 7 is held captive on the lock bolt 10 or 11 which can only be released by a key-holder or equivalent authorised personnel.

We claim:

1. A door arrangement comprising: a door frame; a security door which is hinged in relation to the said frame by hinge means adapted to permit the door to open both inwards to, and outwards from, an area which the door is adapted to close; abutment means associated with the door frame arranged normally to prevent the outward opening of the door, said abutment means being secured by releasable fastening means which are accessible only from outside said area, and are so accessible when the door is closed, whereby release of said fastening means permits the door to be opened outwardly when unlocked if the inward opening path of the door becomes blocked; and a lock for selectively locking the door to the frame, which normally is operable to unlock the door only from outside said area and which can retain the door in engagement with the frame to resist opening of the door in both directions in the absence of said abutment means.

2. A door arrangement according to claim 1 wherein the abutment means include a member pivotally mounted to the door frame by mounting means separate from said fastening means whereby, when said fastening means are released, the said member can be pivoted away from the position in which it prevents the outward opening of the door but is retained in association with the door frame by said mounting means.

3. A door arrangement according to claim 1 wherein the abutment means include a member having an aperture through which a bolt of said lock extends when in the locking position whereby, when said fastening means are released, the said member is held captive in relation to the door frame by said lock bolt until that bolt is withdrawn.

4. A door arrangement according to claim 1 wherein the abutment means include a first member which normally acts to prevent the outward opening of the door and a second member mounted between the first member and the door frame which can act to prevent the outward opening of the door in the absence of the first member; the second member being secured by releasable fastening means which are accessible only when the first member is moved into a position in which it no longer prevents the outward opening of the door.

* * * * *